US008882003B2

(12) United States Patent
Okamoto et al.

(10) Patent No.: US 8,882,003 B2
(45) Date of Patent: Nov. 11, 2014

(54) FUEL INJECTOR

(75) Inventors: Yoshio Okamoto, Omitama (JP); Yoshihito Yasukawa, Hitachinaka (JP); Noriyuki Maekawa, Kashiwa (JP); Nobuaki Kobayashi, Maebashi (JP); Takahiro Saito, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 248 days.

(21) Appl. No.: 13/556,394

(22) Filed: Jul. 24, 2012

(65) Prior Publication Data

US 2013/0026256 A1 Jan. 31, 2013

(30) Foreign Application Priority Data

Jul. 25, 2011 (JP) ..... 2011-161540

(51) Int. Cl.

| | |
|---|---|
| ***F02M 61/18*** | (2006.01) |
| ***F02M 61/10*** | (2006.01) |
| ***F02M 61/06*** | (2006.01) |
| ***F02M 51/06*** | (2006.01) |
| ***B05B 1/34*** | (2006.01) |
| ***F02M 61/16*** | (2006.01) |

(52) U.S. Cl.

CPC ..... *F02M 61/186* (2013.01); *F02M 61/1853* (2013.01); *F02M 61/162* (2013.01)

USPC ..... 239/533.12; 239/468; 239/596

(58) Field of Classification Search

USPC ..... 239/461, 463, 464, 468, 471, 486, 239/533.2, 533.9, 533.12, 585.1–585.5, 239/596, 900; 123/306, 472

See application file for complete search history.

(56) References Cited

U.S. PATENT DOCUMENTS

| | | | | |
|---|---|---|---|---|
| 4,945,877 | A * | 8/1990 | Ziegler et al. | 123/472 |
| 2003/0234005 | A1 * | 12/2003 | Sumisha et al. | 123/467 |
| 2009/0230219 | A1 * | 9/2009 | Matsumura et al. | 239/533.12 |
| 2011/0233307 | A1 * | 9/2011 | Ohno et al. | 239/463 |
| 2012/0193454 | A1 | 8/2012 | Okamoto et al. | |
| 2012/0193566 | A1 * | 8/2012 | Yasukawa et al. | 251/366 |

FOREIGN PATENT DOCUMENTS

JP 2002-364496 A 12/2002

* cited by examiner

*Primary Examiner* — Darren W Gorman
(74) *Attorney, Agent, or Firm* — Crowell & Moring LLP

(57) ABSTRACT

A fuel injector has a swirl generator located downstream from a valve seat. A fuel injection hole is connected to a downstream side of the swirl generator. The swirl generator includes a swirl chamber having an involute or a spiral shape and the fuel injection hole bored at a bottom or the swirl chamber and a swirl generation use passage connected to the upstream side of the swirl chamber for introducing fuel into the swirl chamber. The bottom of the swirl chamber is provided with a step height so as to make a level difference in which the bottom of the swirl chamber is lower than a bottom of the swirl generation use passage, and the step height is formed at a position where fuel flowing into the swirl chamber from the swirl generation use passage meets fuel turning in the swirl chamber.

7 Claims, 6 Drawing Sheets

FUEL INJECTOR

CLAIM OF PRIORITY

The present application claims priority from Japanese application serial no. 2011-161540, filed on Jul. 25, 2011, the content of which is hereby incorporated by reference into this application.

TECHNICAL FIELD

The present invention relates to a fuel injector for an internal combustion engine and, in particular, to a fuel injector that has a plurality of fuel injection holes and injects swirling fuel from each of the fuel injection holes so as to improve atomization performance.

BACKGROUND OF THE INVENTION

As a conventional technology for injecting swirling fuel from a plurality of fuel injection holes to promote fuel atomization, a fuel injector stated in patent literature 1 (Japanese Patent Laid-open No. 2002-364496) is known.

This fuel injector has a casing for the injector, an injection nozzle provided to the casing for injecting fuel filled in the casing to the outside, a movable valve plug provided in the casing for injecting fuel from the injection nozzle when the injector is open, and an actuator provided in the casing for driving the valve plug; in the fuel injector, the injection nozzle is provided with a plurality of swirl generators for generating independent swirls from fuel flowing from the inside of the casing, and a plurality of fuel injection holes (jet orifices) located at the outflow side of each of the swirl generators for injecting swirling fuel in each predetermined direction.

In this fuel injector, the central axis of each fuel injection holes is tilted outward with respect to the central axis of the injection nozzle to allow a spray of fuel injected from each injection hole to partially collide with each other, and the injector efficiently promotes the atomization of the fuel injected from each injection hole.

SUMMARY OF INVENTION

As shown in the conventional technology, in order to inject, from a fuel injection hole (a jet orifice), sufficiently stable (the swirl strength being uniform in the circumferential direction) swirling fuel turning in a swirl chamber (a swirl hole) connected to a swirl generation use passage (a fuel guiding groove) communicating with the downstream end of an valve seat, innovative design is necessary for the shapes of the swirl chamber and the flow passage to make a circumferentially (in the swirling direction) uniform swirl in the outlet portion of the fuel injection hole.

In particular, when the swirl generation use passage has a low height and a rectangular cross-section, which is orthogonal to the flow direction, it is difficult to maintain uniform swirl strength in the swirl chamber and the fuel injection hole.

In such a case, the fuel closer to the center of the swirl chamber in the swirl generation use passage enters the fuel injection hole without sufficiently turning in the swirl chamber compared to the fuel closer to the outer circumference; which is the main cause of nonuniform swirl strength in the circumferential direction. The nonuniformity of the swirl strength in the circumferential direction reduces atomization performance of fuel spraying.

The conventional technology does improve the uniformity of the swirling flow by providing enough height in the swirl chamber and providing a tapered round hole directing toward the inlet of the fuel injection hole downstream. In this method, however, fuel is forced to circle around multiple times in the swirl chamber, which increases a loss in the swirling speed of the fuel, causing a concern that the atomization performance will be reduced for the loss.

The present invention is made in view of the above, and its object is to provide a fuel injector that can improve atomization performance with a simple structure.

In order to achieve the above object, a fuel injector according to the present invention has a swirl generator located downstream from a valve seat on which a valve plug sits and from which the valve plug leaves subsequently to that, and a fuel injection hole connected to a downstream side of the swirl generator. The swirl generator includes a swirl chamber having an involute or a spiral shape and the fuel injection hole bored at a bottom of the swirl chamber, and a swirl generation use passage connected to an upstream side of the swirl chamber for introducing fuel into the swirl chamber. In addition, the bottom of the swirl chamber is provided with a step height so as to make a level difference in which the bottom of the swirl chamber is lower than a bottom of the swirl generation use passage; and the step height is formed at a position where fuel flowing into the swirl chamber from the swirl generation use passage meets fuel turning in the swirl chamber According to the present invention, the step height formed in the swirl generator allows the fuel flowing into the swirl chamber from the swirl generation use passage to smoothly meet the fuel turning in the swirl chamber, so that a stable symmetrical swirl without loss can be generated in the fuel injection hole.

DESCRIPTION OF EMBODIMENTS

Figure 1:
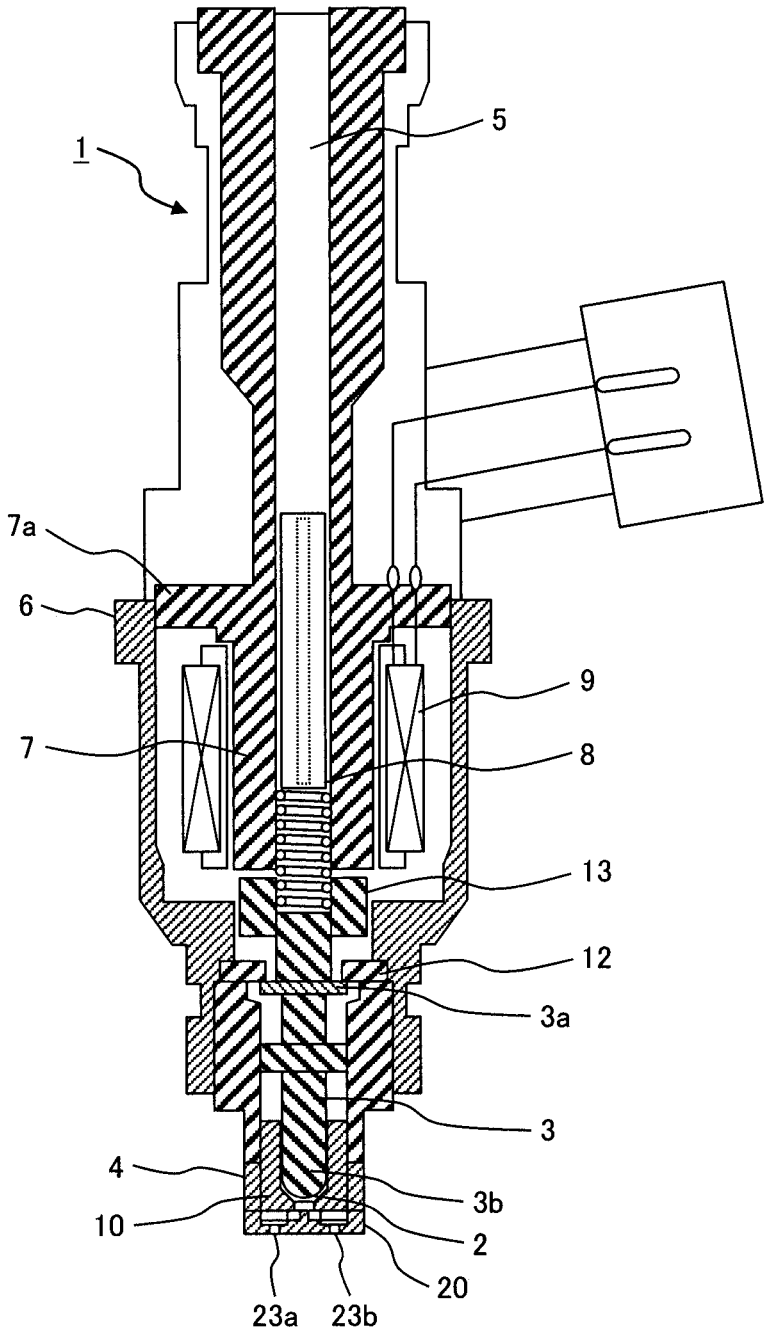
FIG. 1 is a cross-sectional view of the entire structure of a fuel injector according to the first embodiment of the present invention.

In the embodiments of the present invention, a fuel passage has a swirl generator made up of a swirl generation use passage and a swirl chamber, and the swirl generator is communicated and connected with an inlet of a fuel injection hole. A step-height is provided on the bottom surface of the swirl chamber at the outlet side of the swirl generation use passage, that is, where the fuel flowing into the swirl chamber from the swirl generation use passage meets the fuel turning in the swirl chamber. The step-height is provided so as to make a level difference in which the bottom of the swirl chamber is lower than a bottom of the swirl generation use passage; and the step height is formed at a position where fuel flowing into the swirl chamber from the swirl generation use passage meets fuel turning in the swirl chamber.

The step height portion is provided so as to extend from an end point of the sidewall of the swirl chamber, along the edge of the inlet of the fuel injection hole while keeping a distance from the edge of the inlet of the fuel injection hole, and connect to a starting point side of the sidewall (the inner circumferential wall) of the swirl chamber. The distance between the step height portion and the edge of the inlet of the fuel injection hole does not have to be spaced uniformly. For example, when the cross-section of the swirl chamber, which is orthogonal to the central axis of the fuel injector, has an involute or a spiral shape, the step height portion may be formed along a line extending from the end point TE of the sidewall (the peripheral wall surface) 22*sw* of the swirl chamber toward the center O of the involute or the spiral, or it may be formed on the bottom portion outside the line. In this case, the distance between the step height and the edge of the inlet of the fuel injection hole may be made wider downstream than at the end point TE of the sidewall (the circumferential wall surface) 22*sw* of the swirl chamber.

Provided that there is no step height, the fuel flowing into the swirl chamber from the swirl generation use passage changes its flowing direction in the vicinity of a portion where the sidewall of the swirl chamber and the sidewall of the swirl generation use passage are connected, toward the fuel injection hole without maintaining the direction directed by the swirl generation use passage. For this reason, the fuel flowing into the swirl chamber from the swirl generation use passage and changing its flowing direction toward the fuel injection hole, collides at a large angle with the flow flowing from behind the end point of the sidewall of the swirl chamber. As a result, a nonuniform flow without sufficiently turning in the swirl chamber is induced toward the fuel injection hole, thus not only that the fuel flow cannot obtain enough swirl energy but also that it sucks the fuel turning in the swirl chamber into the fuel injection hole; this causes the fuel spray to be formed nonuniformly in the circumferential direction (the swirling direction).

The fuel flow flowing into the swirl chamber from the swirl generation use passage and changing its flowing direction toward the fuel injection hole, is called as the first fuel flow; and the fuel flow tuning in the swirl chamber and flowing from behind the end point of the sidewall (the circumferential wall) of the swirl chamber is called as the second fuel flow.

A portion where the sidewall (the circumferential wall formed along the involute or the spiral shape when the swirl chamber has an involute or a spiral shape) of the swirl chamber and the sidewall of the swirl generation use passage are connected, has a substantive thickness due to a manufacturing limitation or a strength concern. Thus, it is difficult to make the fuel flowing into the swirl chamber from the swirl generation use passage meet the second fuel flow in the tangent direction. In other words, the first fuel flow is generated. The thicker the thickness of the connecting portion between the sidewall of the swirl chamber and the sidewall of the swirl generation use passage, the larger the angle of collision of the fuel, flowing into the swirl chamber from the swirl generation use passage, to the fuel tuning in the swirl chamber.

Providing the step height makes the second fuel flow to flow along the step height portion without colliding with the first fuel flow, allowing the second fuel flow flowing under the first fuel flow to continue flowing in the swirling direction. Furthermore, the second fuel flow continuing to flow in the swirling direction induces the first fuel flow flowing above the second fuel flow and directed toward the fuel injection hole, to flow in the swirling direction. Consequently, the first fuel flow can be recovered to flow in the swirling direction.

As described above, the distance between the step height and the edge of the inlet of the fuel injection hole becomes wider downstream than at the end point of the sidewall (the circumferential) of the swirl chamber. This allows the direction of the flow line of the second fuel flow to be parallel to the edge of the inlet of the fuel injection hole without forcefully changing it toward the fuel injection hole, or rather, allows the second fuel flow to draw a larger curvature than the curvature of the edge of the inlet. Thus, the first fuel flow flowing above the second fuel flow toward the fuel injection hole can be induced in the swirling direction, and the flow of the first fuel flow in the swirling direction can be recovered.

From above, a liquid film, which has been turned into a thin film by sufficient swirl strength, is formed uniformly in the circumferential direction at the outlet of the fuel injection hole, which promotes the atomization of the fuel spray.

Embodiments of the present invention will be described below with reference to FIGS. 1 to 10.

EXAMPLE 1

A first embodiment will be described in detail below with reference to FIGS. 1 to 6.

Figure 2:
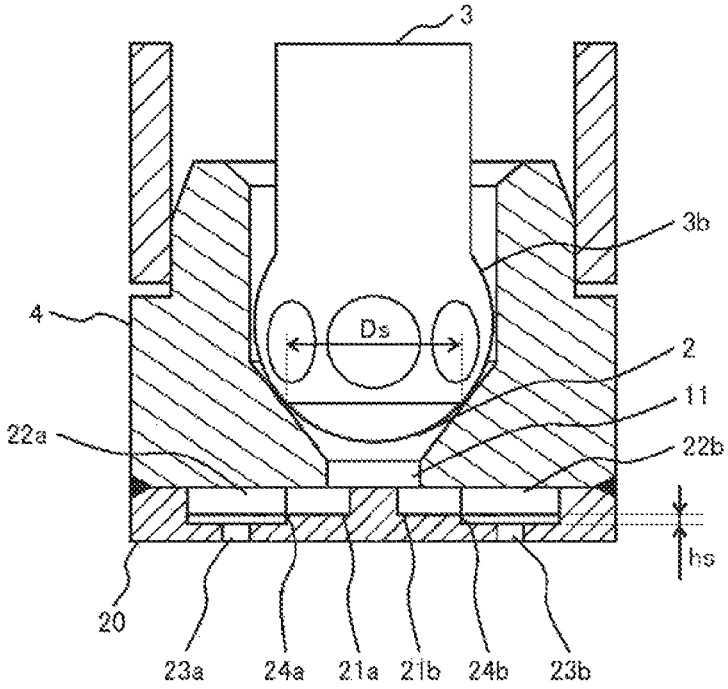
FIG. 2 is an enlarged cross-sectional view of the lower end portion of a nozzle body in the fuel injector according to the first embodiment.
Figure 3:
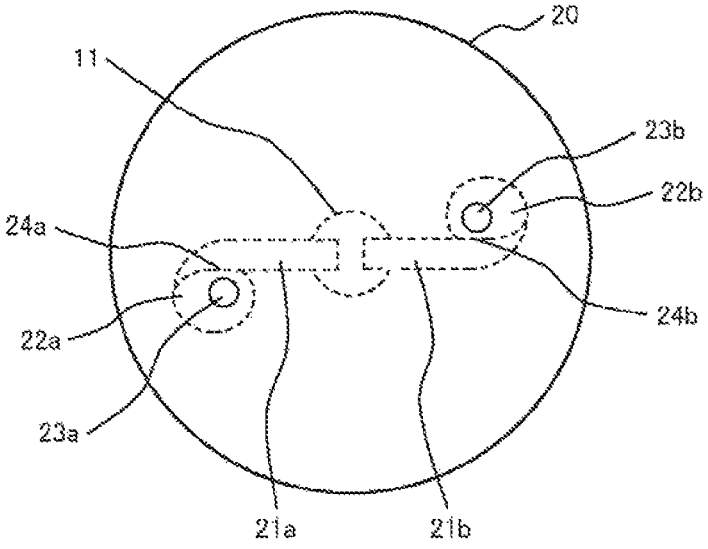
FIG. 3 is a view from below of an orifice plate located in the lower end portion of the nozzle body in the fuel injector according to the first embodiment.
Figure 4:
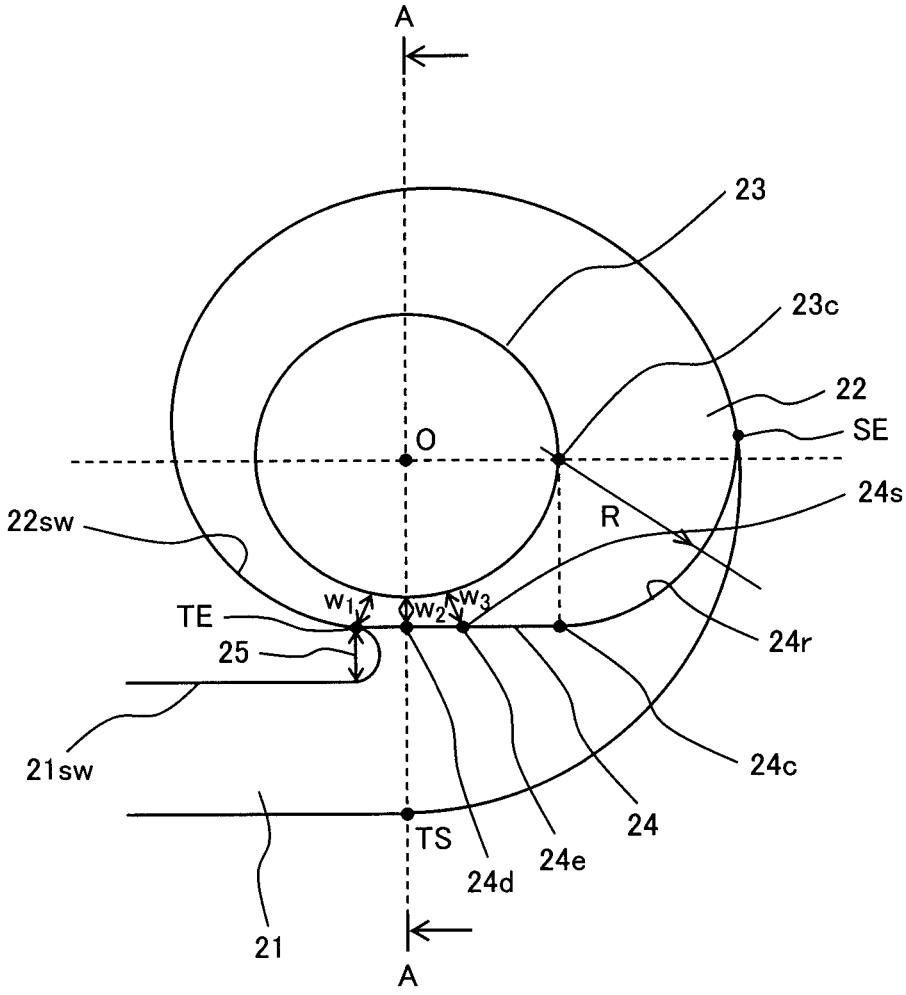
FIG. 4 illustrates a level difference in the first embodiment; it is an enlarged view showing a relationship among a swirl chamber, a swirl generation use passage, and a fuel injection hole.
Figure 5:
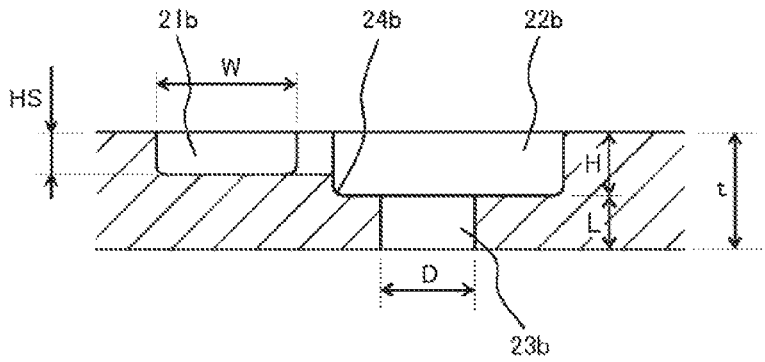
FIG. 5 is a cross-sectional view taken along A-A of FIG. 4, illustrating a relationship among the swirl chamber, the swirl generation use passage, and the fuel injection hole in the same manner.
Figure 6:
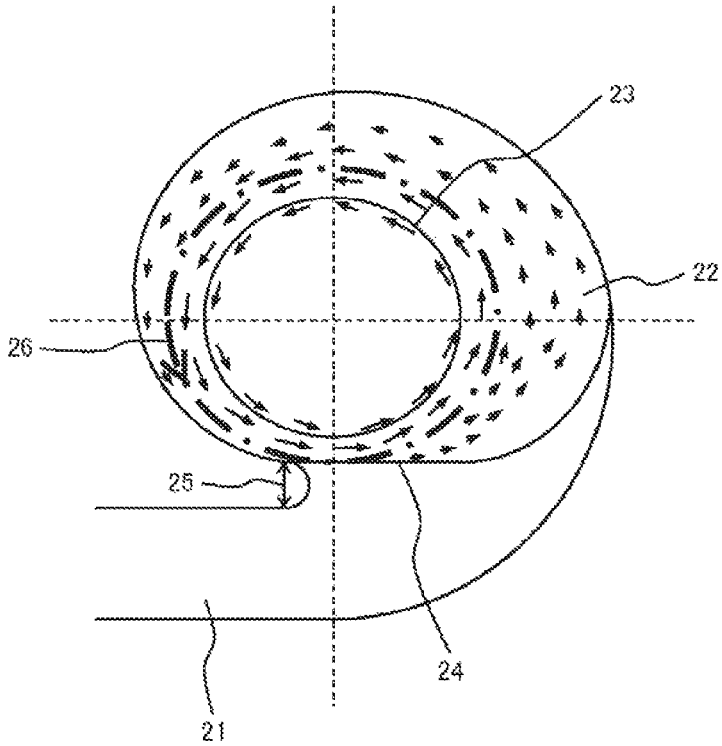
FIG. 6 is a schematic diagram illustrating the appearance of a flow (a velocity vector) in the swirl chamber according to the first embodiment.
Figure 7:
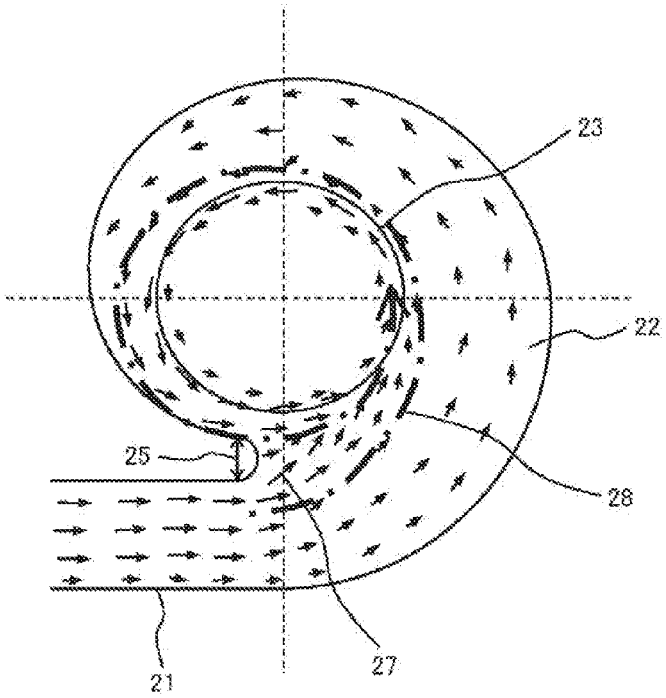
FIG. 7 RELATED ART
FIG. 7 is a schematic diagram illustrating the appearance of a flow (a velocity vector) in the swirl chamber according to a conventional embodiment (i.e., related art).

FIG. 1 is a vertical cross-sectional view of the fuel injector according to the first embodiment, and the cross-sectional view parallel to a central axis of the fuel injector. FIG. 2 is a vertical cross-sectional view of the vicinity of fuel injection holes, particularly enlarging a downstream end side of the fuel injector in FIG. 1. FIG. 3 shows an orifice plate viewed from an outlet side thereof. FIG. 4 is a partial top view of the orifice plate, showing a relationship among a passage for use in generating a swirl, a swirl chamber, and a fuel injection hole. FIG. 5 is a cross-sectional view taken along A-A of FIG. 4. FIG. 6 shows velocity vectors of a flow in the swirl chamber. FIG. 7 shows velocity vectors of a flow in the swirl chamber when no level difference is provided.

In FIG. 1, a fuel injector 1 includes a magnetic yoke 6 surrounding an electromagnetic coil 9; a stationary core 7 located in a center of the electromagnetic coil 9, having a flange 7*a* contacting an inner surface of the yoke 6; an valve plug 3 as a movable element capable of moving within a predetermined operating range; a valve seat 10 on which the valve plug 3 sits during valve closing; a fuel injection chamber 2 which passes a fuel flowing through a gap between the valve plug 3 and the valve seat 10 during valve opening; and an orifice plate 20 having a plurality of fuel injection holes 23*a* and 23*b*, provided downstream from the fuel injection chamber 2.

A spring 8 is provided in the center of the stationary core 7 as an elastic member (a pressing member) for pressing the valve plug 3 to the valve seat 10.

When the electromagnetic coil 9 is not energized, the valve plug 3 sits on the valve seat 10 so as to keep in a valve closing state. In this condition, since a fuel passage between the valve plug 3 and the valve seat 10 is closed, the fuel remains in the fuel injector 1 and no fuel is injected from the plurality of fuel injection holes 23*a* and 23*b*.

On the other hand, the electromagnetic coil 9 is energized, the valve plug 3 is moved by an electromagnetic force until a flange 3*a* of the valve plug 3 comes into contact with a stopper 12 for defining the amount of a stroke of the valve plug. Thereby, the injector turns to a valve opening state. Instead of the stopper 12 and the flange 3*a*, a top surface of an anchor 13 as a movable core integrated with the valve plug 3 may come in contact with a bottom surface of the stationary core 7.

In this valve opening state, a gap is formed between the valve plug 3 and the valve seat 10, thus the fuel passage is opened to inject fuel from the plurality of fuel injection holes 23*a* and 23*b*.

A fuel passage 5 provided in the stationary core 7 is to introduce the fuel pressurized by a fuel pump (not illustrated in the figure) into the fuel injector 1.

The fuel injector 1 operates as described above, that is, by controlling on/off of energization (injection pulse) to the electromagnetic coil 9, the valve plug 3 moves between a valve opening position and a valve closing position, so the amount of fuel supply is controlled.

With regard to the control of fuel supply, the valve plug is particularly designed to prevent fuel leak in the valve closing state.

This kind of fuel injector uses a ball 3*b* having a high circularity and a mirror surface finish (a JIS-standard steel ball for ball bearing) in the valve plug 3 to efficiently improve seating effectiveness.

The surface forming the valve seat 10 where the ball 3*b* comes into contact with, has an optimum angle (80° to) 100° to have good abradability and allow the ball 3*b* to be highly accurate circularity so that the ball 3*b* can sit on the valve seat 10 while maintaining high seat performance.

A nozzle body 4 having the valve seat 10 is hardened to improve its hardness, and unnecessary magnetism is removed by demagnetizing treatment.

Such a structure of the valve plug 3 allows the amount of fuel injection to be controlled without fuel leak. Additionally, it achieves good cost performance.

A structure of one-end side portion of the injector in a downstream side of the nozzle body 4 (in the vicinity of the fuel injection holes) will be described with reference to FIG. 2. An orifice plate 20 is fixed to the lower-side one end of the nozzle body 4 by laser welding. The orifice plate 20 is provided with a plurality of swirl generation use passages (21*a*, 21*b*), swirl chamber (22*a*, 22*b*), and step-height portions (24*a* 24*b*) other than a plurality of orifices as fuel injection holes (23*a*, 23*b*) as described below.

A lower end portion of the nozzle body 4A is provided with a fuel feeding hole 11 having a diameter smaller than a seat diameter Ds of the valve seat 10.

The fuel feeding hole 11 communicates with a plurality of swirl generation use passages 21*a* and 21*b* provided in the orifice plate 20.

The swirl generation use passages (21*a*, 21*b*) communicates with the swirl chambers (22*a*, 22*b*) respectively. The bottoms of the swirl chambers (22*a*, 22*b*) are provided with the fuel injection holes (23*a*, 23*b*) respectively. The step height portions (24*a*, 24*b*) are provided in the swirl chambers (22*a*, 22*b*) respectively. Namely, the step height portions (24*a*, 24*b*) is formed so that the bottoms of the swirl chambers (22*a*, 22*b*) are one step lower than the bottoms of the swirl generation use passages (21*a*, 21*b*).

The sidewalls (the circumferential wall) 22*sw* of the swirl chambers 22*a* and 22*b*, each which defines a spread of the swirl chamber in a radial direction (the direction orthogonal to the central axis of the fuel injector), are formed in an involute shape or a spiral shape, and the respective centers of the swirl chambers 22*a* and 22*b* (the center of each involute shape or each spiral shape) are provided with the fuel injection holes 23*a* and 23*b* respectively.

The step height portions (24*a*, 24*b*) are integrated with the swirl generation use passages (21*a*, 21*b*), the swirl chambers (22*a*, 22*b*), and the fuel injection holes (23*a*, 23*b*) in a single-piece construction of the orifice plate 20.

Such an arrangement allows the nozzle body 4 and the orifice plate 20 to be positioned easily and enhances dimensional accuracy when they are put together.

The orifice plate 20 is manufactured by press forming (plastic forming) which is advantageous in high-volume production. Other than this method, a method having high processing accuracy without much stress such as electrodischarge machining, electroforming, and etching may be used.

The present embodiment is provided with two swirl chambers for fuel. However, they can be increased in number to increase the freedom in varying a spray shape or the injection amount.

Next, the structure of the orifice plate 20 will be described in detail with reference to FIGS. 3 to 7.

FIG. 3 shows the structure in FIG. 2 viewed from below (from the outlet side of the fuel injection holes 23*a* and 23*b*).

A plurality of (two in the present embodiment) swirl generation use passages 21*a* and 21*b* are connected to the downstream-side one end of the fuel feeding hole 11 provided in the nozzle body 4. The fuel feeding hole 11 is positioned downstream from the valve seat 10 in the center of the valve body 4.

The swirl generation use passage 21*a* communicates with the swirl chamber 22*a* in a tangent direction, and the fuel injection hole 23*a* is bored at the center of the swirl chamber 22*a*.

The swirl chamber 22*a* is formed in an involute shape or a spiral shape, and the center of swirl, namely the center of the involute shape or the spiral shape coincides with the center of the fuel injection hole 23*a*. The description below assumes that the swirl chamber 22*a* has the spiral shape.

The step height portion 24*a* is formed in the vicinity of a connecting portion between the swirl chamber 22*a* and the swirl generation use passage 21*a* to provide a level difference of a height (hs) between the bottom of the swirl generation use passage 21*a* and the bottom of the swirl chamber 22*a* on which an inlet of the fuel injection hole 23*a* is provided.

In the same manner, the swirl generation use passage 21*b* communicates with the swirl chamber 22*b* in a tangent direction, and the fuel injection hole 23*b* is bored at the center of the swirl chamber 22*b*.

The swirl chamber 22*b* is formed in an involute shape or a spiral shape, and the center of swirl, namely the center of the involute shape or the spiral shape coincides with the center of the fuel injection hole 23*b*. The description below assumes that the swirl chamber 22*b* has a spiral shape.

Just as with the step height portion 24*a*, the step height portion 24*b* is formed in the vicinity of a connecting portion between the swirl chamber 22*b* and the swirl generation use passage 21*b* to provide a level difference of the height (hs) between the bottom of the swirl generation use passage 21*b* and the bottom of the swirl chamber 22*b* on which an inlet of the fuel injection hole 23*b* is provided.

The fuel injection holes 23*a* and 23*b* (the direction of fuel flow) in the present embodiment is directed downward in parallel to the axis of the injector, but it may be tilted to a desired direction to disperse spray (to keep each spray away from each other to prevent interference).

The design of the swirl chamber 22*b* having the step height portion 24*b* will be described with reference to FIGS. 4 and 5. The swirl generation use passage 21*a* and the swirl chamber 22*a*, and the swirl generation use passage 21*b* and the swirl chamber 22*b* each constitute a swirl generator in the fuel passage, and each swirl generator is communicated with each of the fuel injection holes 23*a* and 23*b*. The swirl generators having the fuel injection holes 23*a* and 23*b* are symmetrical with respect to the central axis of the fuel injector. Thus, the description below does not distinguish the swirl generation use passages 21*a* and 21*b*, the swirl chambers 22*a* and 22*b*, and the fuel injection holes 23*a* and 23*b*; they are simply described as the swirl generation use passage 21, the swirl chamber 22, and the fuel injection hole 23 respectively.

The cross-section of the swirl generation use passage 21, which is orthogonal to the flowing direction, is rectangular and designed to be advantageous dimensions for press forming. In particular, a height HS is made smaller compared to a width W of the swirl generation use passage 21 for better workability.

Since the swirl generation use passage 21 where the fuel flows into from the fuel feeding hole 11, is narrowed in its cross-section rectangular portion (which has a minimum cross-sectional area in the fuel passage of the injector), pressure loss of the fuel from the valve seat 10 to the swirl generation use passage 21 through the fuel injection chamber 2 and the fuel feeding hole 11 can be ignored.

In particular, the fuel feeding hole 11 is designed to have preferable dimensions as a fuel passage to prevent rapid bending pressure loss.

Thus, the pressure energy of the fuel is efficiently converted into swirl velocity energy in the swirl generation use passage 21.

The flow accelerated in the cross-section rectangular portion is introduced to the fuel injection hole 23 downstream from the swirl generation use passage 21 while maintaining enough swirl strength, that is, swirl velocity energy.

The swirl strength (swirl number S) of the fuel can be shown in equation (1).

[Equation 1]

$$S = \frac{d \cdot LS}{n \cdot ds^2} \qquad \text{Equation (1)}$$

[Equation 2]

$$ds = \frac{2 \cdot W \cdot HS}{W + HS} \qquad \text{Equation (2)}$$

Note that d is a diameter of the fuel injection hole, LS is a distance between the center line of the swirl generation use passage 21 and the center of the swirl chamber 22, and n is the number of swirl generation use passages. n is 1 in the present embodiment.

In addition, ds is a hydraulic diameter of the swirl generation use passage, as shown in equation 2, where W is the width of the swirl generation use passage and HS is the height of the swirl generation use passage 21.

With regard to the dimensions of the swirl chamber 22, a diameter DS is determined so as to minimize the effect of friction loss at the chamber interior wall and friction loss caused by the fuel flow. In the present embodiment, the swirl chamber 22 since has a spiral shape, the diameter DS has a value twice the distance between an end point (starting point of swirl) TS of the spiral curve and a center O of the spiral (FIG. 4). This DS is equal to the diameter of the reference circle of the spiral.

The optimum size of DS is said to be approximately four to six times the hydraulic diameter ds, thus this is also adopted in the present embodiment.

The step height portion 24 is formed at a connecting portion between a sidewall 22*sw* of the swirl chamber 22 and a sidewall 21*sw* of the swirl generation use passage 21.

This connecting portion has a thickness 25, which is designed to be approximately 0.1 millimeters or smaller. This length is advantageous in press work to extend mold life. The thickness is practically necessary due to a manufacturing limitation or a strength concern.

The step height portion 24 extends straightly from an end point (a location of the thickness 25) TE of the swirl chamber 22, and connects with the sidewall 22*sw* of the swirl chamber 22 smoothly through a curved surface having a curvature R. In other words, a wall constituting the step height portion 24 has a straight-line wall 24*s* extending straightly and a curved wall 24*r* having a curvature line R. When defining a first point 23*c* by a point where a straight-line segment passing the center of the fuel injection hole 23, parallel to the straight-liner wall 24*s*, crosses the fuel injection hole 23; and when defining a second point 24*c* by a point where a perpendicular line from the first point 23*c* crosses to the straight-line wall 24*s*. In this case, the straight-line wall 24*s* exceeds the second point 24*c*.

The step height portion 24 will be described in more detail. In the bottom of the swirl chambers 22, a part of the bottom in the vicinity of a connection portion between the swirl chamber 22 and the swirl generation use passage 21 has the same level as the bottom of the swirl generation, the other of the bottom of the swirl chamber 22 is one step lower than the bottom of the swirl generation use passage 21. In order to form such a difference level of the bottoms, the step height portion 24 is provided so as to extend from an end point TE of the sidewall 22*sw* of the swirl chamber 22, along the edge of the inlet of the fuel injection hole 23 while keeping a distance from the edge of the inlet of the fuel injection hole 23, and connect to a starting point side SE of the sidewall (the inner circumferential wall) 22*sw* of the swirl chamber 22. The sidewall 22*sw* of the swirl chamber 22 and the wall of the step height portion 24 together surround the inlet of the fuel injection hole 23. The distance between the step height portion 24 and the edge of the inlet of the fuel injection hole 23 does not have to be spaced uniformly. For example, when the cross-section of the swirl chamber 22, which is orthogonal to the central axis of the fuel injector, has an involute or a spiral shape, the step height portion may be formed along a line extending from the end point TE of the sidewall (the peripheral wall surface) 22*sw* of the swirl chamber toward the center O of the involute or the spiral, or it may be formed on the bottom portion outside the line. In this case, the distance between the step height and the edge of the inlet of the fuel injection hole 23 may be made wider downstream than at the end point TE of the sidewall (the circumferential wall surface) 22*sw* of the swirl chamber. A distance $w_1$ from the end point TE, a distance $w_2$ from a point 24*d*, and a distance $w_3$ from a point 24*e* have the following relationship: $w_2<w_1<w_3$.

By providing the step height 24, most of the bottom of the swirl chamber 22 is recessed by one step lower than the bottoms of the swirl generation use passage 21 and a part of the swirl chamber 22. A sidewall of the recessed portion of the swirl chamber 22 is formed by the step height 24 and the lower part of the sidewall of the swirl chamber 22. By providing the step height 24, a second fuel flow (the flow behind the end point TE of the sidewall 22*sw* of the swirl chamber) flows along the step height portion 24 without colliding with a first fuel flow (the fuel flow flowing into the swirl chamber from the swirl generation use passage and turning its direction to the fuel injection hole). The second fuel flow flowing under the first fuel flow continues flowing in the swirling direction, so that the second fuel flow induces the first fuel flow flowing above the second fuel flow toward the fuel injection hole 23 to flow in the swirling direction. Consequently, the first fuel flow also can be recovered to flow in the swirling direction.

As described above, a portion 24*e* has a distance w3 wherein a distance w between the step height 24 and the edge of the inlet of the fuel injection hole 23 becomes wider downstream than at the end point TE of the sidewall (the circumferential wall) of the swirl chamber 22. Thereby, a direction of the flow line of the second fuel flow can be in parallel to the edge of the inlet of the fuel injection hole 23 without forcefully changing the direction toward the fuel injection hole 23, or rather, the second fuel flow can draw a curvature larger than the curvature of the edge of the inlet. Thus, the first fuel flow flowing above the second fuel flow toward the fuel injection hole 23 can be induced to flow in the swirling direction, and the flow of the first fuel flow in the swirling direction can be recovered.

Consequently, a liquid film, which has been turned into a thin film by sufficient swirl strength, is formed uniformly in the circumferential direction at the outlet of the fuel injection hole, which promotes the atomization of the fuel spray.

The curvature R is designed to be approximately 0.1 to 0.2 millimeters, and a smooth flow is formed without generating any swirl near the wall of the swirl chamber.

The height of the step height portion 24 is designed to be approximately half of the height HS of the swirl generation use passage 21 (around 0.07 millimeter).

The diameter D of the fuel injection hole 23 is sufficiently large. The diameter D is a diameter large enough to make a hollow inside the fuel injection hole 23. That is, this helps the injection fuel to become a flow in the form of a thin film without losing the swirl velocity energy. In addition, a length L of the fuel injection hole 23 is the same as a height H of the swirl chamber 22, and a ratio L/D of the length L to a diameter D of the fuel injection hole is small, so that the loss of the swirl velocity energy is extremely small. This makes the atomization performance of the fuel superior.

Furthermore, the ratio of the diameter of the fuel injection hole 23 to the diameter of the injection hole is small, so that the workability of press work can be improved.

Such a structure not only reduces cost but also improves workability, which prevents variation in dimensions, thus the robustness of a spray shape and the injection amount is dramatically improved.

FIGS. 6 and 7 visualize the fuel flow in the swirl chamber 22, showing the flow appearance using the length and the direction of velocity vectors.

FIG. 6 visualizes the fuel flow when the step height portion 24 is provided, and FIG. 7 visualizes the fuel flow when no step height portion is provided.

When Looking at the flow shown in FIG. 7 first, a swirling flow is generated behind the thickness 25, thereby, the pressure in this region is reduced lower than its surroundings, thus, as shown in a velocity vector 27, the fuel flowing into the swirl chamber 22 from the swirl generation use passage 21 is precipitously turned toward the fuel injection hole 23 and collides with a circling flow at a large angle.

Due to this collision, a strong nonuniform flow is generated in the swirl chamber 22 and immediately flows into the fuel injection hole 23.

As a result, a stronger flow is generated in the left side than the right side of the fuel injection hole 23 in the figure.

Simulation of this flow is shown in a thick line (an alternate long and short dash line) in the figure as an arrow 28, and clearly indicates the formation of an asymmetrical flow with respect to the center of the fuel injection hole 23 (the swirl center of the spiral).

This causes the hollow (the cavity) formed inside the fuel injection hole 23 to be asymmetrical. Thus, the distribution of the liquid film of the injection fuel at the outlet of the fuel injection hole 23 becomes nonuniform.

On the other hand, when looking at the flow in FIG. 6, the fuel flowing into the swirl chamber 22 from the swirl generation use passage 21 and turning in the swirl chamber 22, is guided by the wall of the step height portion 24. Thereby, it is possible to prevent the collision of the flow turning in the swirl chamber 22 and the flow flowing into the swirl chamber 22 from the swirl generation use passage 21 (wherein flowing direction of the flow flowing into the swirl chamber 22 from the swirl generation use passage 21 is precipitously turned toward the fuel injection hole 23 by the effect of the reduced pressure generated by the thickness 25); thus, swirling flow toward the fuel injection hole 23 is not formed uniformly.

In the same manner, as shown in the arrow 26 in the figure, a symmetrical (even in the circumferential direction) flow is formed in the vicinity of the fuel injection hole 23.

This makes the hollow formed in the fuel injection hole 23 to be symmetrical even if the swirling fuel flows into the fuel injection hole. Thus, at the outlet of the fuel injection hole 23, the distribution of the liquid film of the fuel can be formed uniformly.

By forming the distribution of the liquid film of the fuel uniformly in the circumferential direction, at the same time, it is possible to make the film thinner compared to the conventional example. Spraying the fuel in the form of such a thin film allows active exchange of energy with the surrounding air, promoting disintegration of the fuel to make a well-atomized spray.

EXAMPLE 2

Figure 8:
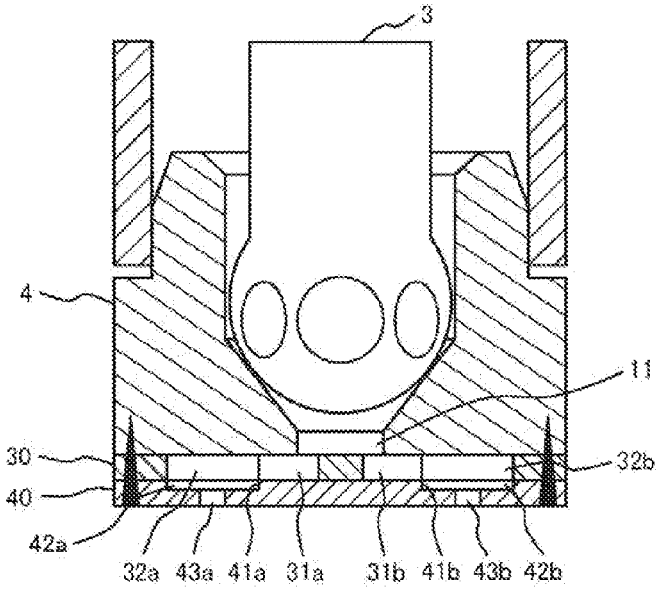
FIG. 8 is an enlarged cross-sectional view of the lower end portion of a nozzle body in a fuel injector according to the second embodiment of the present invention.
Figure 9:
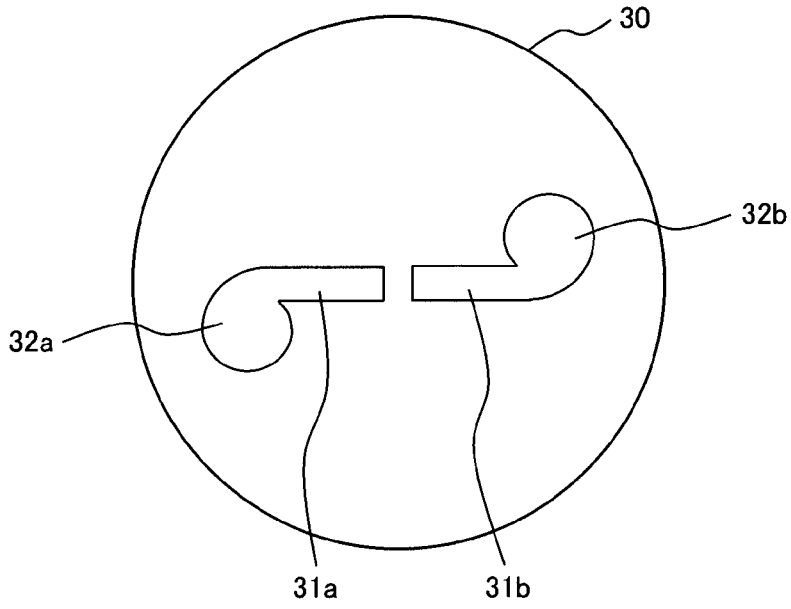
FIG. 9 shows a swirl plate according to the second embodiment of the present invention.
Figure 10:
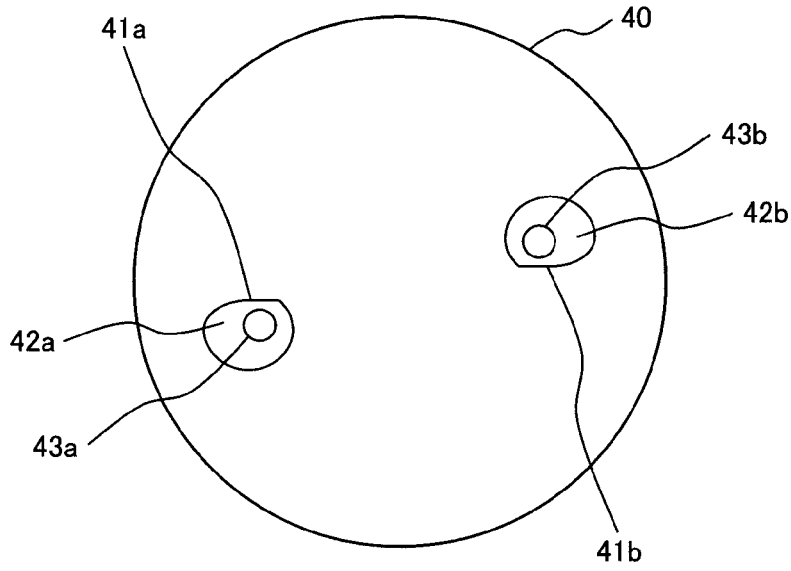
FIG. 10 shows an orifice plate according to the second embodiment of the present invention.

A second embodiment of the fuel injector according to the present invention will be described in detail below with reference to FIGS. 8 to 10. FIG. 8, in the same manner as FIG. 2, is an enlarged vertical cross-sectional view of the vicinity of the fuel injection hole in the downstream end side. FIG. 9 is a plan view illustrating a swirl plate 30, and FIG. 10 is a plan view illustrating an orifice plate 40.

A difference from the fuel injector in the first embodiment (Example 1) is that the orifice plate 20 in FIG. 2 is made with the swirl plate 30 and the orifice plate 40 as a two-part structure.

The swirl plate 30 is configured by a thin plate member made of a steel plate, having swirl generation use passages (31*a*, 31*b*) and bottomless upper-side swirl chambers (32*a*, 32*b*).

The orifice plate 40 is a thin plate member made of a steel plate, having bottoming lower-side swirl chambers (42*a*, 42*b*) and fuel injection holes (43*a*, 43*b*).

By combining the swirl chambers (32*a*, 32*b*) and the swirl chamber, the finished swirl chambers are formed respectively. The swirl chambers 42*a* and 42*b* located downstream from the swirl chambers 32*a* and 32*b* are designed to be slightly larger than the swirl chambers 32*a* and 32*b*.

In particular, since the swirl generation use passages 31*a* and 31*b* of the swirl plate 30 each have a minimum area in the fuel passage of the fuel injector, as described above, they should be produced without variation.

The press work of the swirl plate 30 is made easier by the two-part structure, so that the production becomes stable and variation in individual pieces is reduced, thus a highly-robust injection nozzle can be achieved.

The swirl plate 30 is provided with the swirl generation use passages 31*a* and 31*b* communicating with the upper-side swirl chambers 32*a* and 32*b* having a spiral curve; the flow appearance is the same as that in the first embodiment.

In the orifice plate 40, a part of the side wall of the swirl chambers 42*a* and 42*b* is a wall forming a step height portions 41*a* and 41*b* in the same manner as in the step height portion 24 (24*a* and 24*b*) in the first embodiment. The orifice plate 40 has a spiral wall surface (in the same manner as the spiral curve of the swirl plate 30) whose curvature becomes gradually larger from the wall forming each of the step height portions 41*a* and 41*b*.

In addition, the fuel injections holes 43*a* and 43*b* are formed in the center (the swirl center) portion of the spiral curve.

Returning to FIG. 8, the swirl plate 30 and the orifice plate 40 are attached to the lower end point of the nozzle body 4 in this order, and fixed to the nozzle body 4 by welding the outer circumferential region with laser.

In this embodiment, the swirl chambers 42*a* and 42*b* of the orifice plate 40 are preferably made slightly larger than the swirl chambers 32*a* and 32*b* of the swirl plate 30, as described above. This can absorb displacement due to heat deformation at the time of laser welding.

In addition, since those finished swirl chambers originally have a two-part structure respectively, less heat is transferred to the swirl plate 30 at the time of laser welding, thus heat deformation of the swirl generation use passages 31*a* and 31*b* is reduced, consequently more accurate spraying can be achieved.

Further, the static injection amount of the fuel injector can be adjusted with the swirl plate 30 having a minimum passage area. That is, a flow rate can be adjusted by selecting and fitting a plate from already produced plates.

Furthermore, the swirl plate 30 may be made of non-metallic material, or made as one body with the nozzle body to allow innovative ideas such as these to be applied to improve productivity.

As described above, the fuel injector according to each embodiment of the present invention provides a step-height (level-difference region) in the swirl chamber so that, when swirling fuel is to be injected from each of the plurality of fuel injection holes, a thin film of injection fuel can be formed uniformly while maintaining its symmetry to promote atomization.

This step height is located in vicinity of the connecting portion between the swirl chamber and the swirl generation use passage, and forms a level difference between the bottom surface of the swirl generation use passage and the bottom surface of the swirl chamber having the fuel injection hole.

The fuel flowing into the swirl chamber is guided by the wall of the step height portion and prevented from colliding with the fuel tuning in the swirl chamber. Thus, a swirling flow is formed uniformly in the circumferential direction in the swirl chamber and the fuel injection hole, and the fuel is promoted to be in the form of a very thin film.

Spraying the fuel in the form of such an uniform thin film allows active exchange of energy with the surrounding air, promoting disintegration to make a well-atomized spray.

In addition, the specification is designed to make press work easier, so that an inexpensive fuel injector having a superior cost performance can be achieved.

What is claimed is:

1. A fuel injector comprising a swirl generator located downstream from a valve seat on which a valve plug sits and from which the valve plug subsequently leaves, and a fuel injection hole connected to a downstream side of the swirl generator, wherein the swirl generator includes a swirl chamber having an involute or a spiral shape and the fuel injection hole bored at a bottom of the swirl chamber, and a swirl generation use passage connected to an upstream side of the swirl chamber for introducing fuel into the swirl chamber;

wherein the bottom of the swirl chamber is provided with a step height so as to make a level difference in which the bottom of the swirl chamber is lower than a bottom of the swirl generation use passage, and the step height is formed at a position where fuel flowing into the swirl chamber from the swirl generation use passage meets fuel turning in the swirl chamber.

2. The fuel injector according to claim 1, wherein a wall forming the step-height extends from an end point of an inner circumferential wall of the swirl chamber having an involute or a spiral curve, along an edge of an inlet of the fuel injection hole while keeping a distance from the edge of the inlet of the fuel injection hole.

3. The fuel injector according to claim 2, wherein the distance between the step height and the edge of the inlet includes a distance ($w_1$) at the end point and a distance ($w_3$) at a position away from the end point in an extending direction of the step height, the distance $w_3$ being wider than the distance $w_1$.

4. The fuel injector according to claim 3, wherein the step height is connected to a starting point side of the inner circumferential wall of the swirl chamber.

5. The fuel injector according to claim 4, wherein one-end side portion of the step height connecting to the starting point side of the inner circumferential wall of the swirl chamber is provided with a curved-line wall having a given curvature.

6. The fuel injector according to claim 5, wherein the step height has a straight line part between the end point of the swirl chamber and the curved-line wall.

7. The fuel injector according to claim 1, wherein a height of the step height is smaller than a height of the swirl generation use passage.

* * * * *